US009397460B2

(12) United States Patent
Zhou et al.

(10) Patent No.: US 9,397,460 B2
(45) Date of Patent: Jul. 19, 2016

(54) ELECTRONIC DEVICE AND CABLE CONNECTING MECHANISM THEREOF

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Xiao-Gang Zhou, Shenzhen (CN); Wei-Min Yang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 56 days.

(21) Appl. No.: 14/554,336

(22) Filed: Nov. 26, 2014

(65) Prior Publication Data

US 2015/0155671 A1 Jun. 4, 2015

(30) Foreign Application Priority Data

Nov. 30, 2013 (CN) ..... 2013 1 0622118

(51) Int. Cl.
*H01R 39/00* (2006.01)
*H01R 35/02* (2006.01)

(52) U.S. Cl.
CPC ..... *H01R 35/025* (2013.01); *H01R 2201/06* (2013.01)

(58) Field of Classification Search
CPC ..... H01R 35/00; H01R 13/56
USPC ..... 439/13, 446, 8
See application file for complete search history.

(56) References Cited

U.S. PATENT DOCUMENTS

| | | | | |
|---|---|---|---|---|
| 5,554,039 | A * | 9/1996 | Doudon | H01R 25/145 439/115 |
| 5,735,707 | A * | 4/1998 | O'Groske | H01R 13/5841 439/446 |
| 5,915,974 | A * | 6/1999 | Carter | H01R 35/04 439/13 |
| 6,196,864 | B1 * | 3/2001 | Huguenet | G02B 6/3833 439/446 |
| 6,789,653 | B1 * | 9/2004 | Hsu | H01R 35/04 191/12.2 R |
| 6,979,214 | B1 * | 12/2005 | Liou | H01R 35/04 439/13 |
| 2004/0239205 | A1 * | 12/2004 | Habele | H01R 39/28 310/233 |
| 2010/0151699 | A1 * | 6/2010 | Cho | H01R 35/04 439/13 |

* cited by examiner

*Primary Examiner* — Abdullah Riyami
*Assistant Examiner* — Nader J Alhawamdeh
(74) *Attorney, Agent, or Firm* — ScienBiziP, P.C.

(57) ABSTRACT

An electronic device includes a first member, a second member electrically and rotatably coupled to the first member, a cable connecting mechanism, and a cable. The cable connecting mechanism includes a housing defining a holding chamber, a pivot assembly, and two elastic members. The pivot assembly includes a first conductive portion received in the holding chamber, and a second conductive portion received in the holding chamber and insulated from the first conductive portion. A first elastic member extends through the housing to resist and electrically couple the first conductive portion. A second elastic member extends through the housing to resist and electrically couple the second conductive portion. The cable extends into the housing to be electrically coupled to the first conductive portion and the second conductive portion.

20 Claims, 6 Drawing Sheets

ELECTRONIC DEVICE AND CABLE CONNECTING MECHANISM THEREOF

FIELD

The subject matter herein generally relates to an electronic device, and in particular to an electronic device with an rotatable cable connecting mechanism.

BACKGROUND

Cables are employed in an electronic device to electrically connect with a power source and an electronic component, thus providing interface with the electronic device.

BRIEF DESCRIPTION OF THE DRAWINGS

Implementations of the present technology will now be described, by way of example only, with reference to the attached figures.

DETAILED DESCRIPTION

Figure 1:
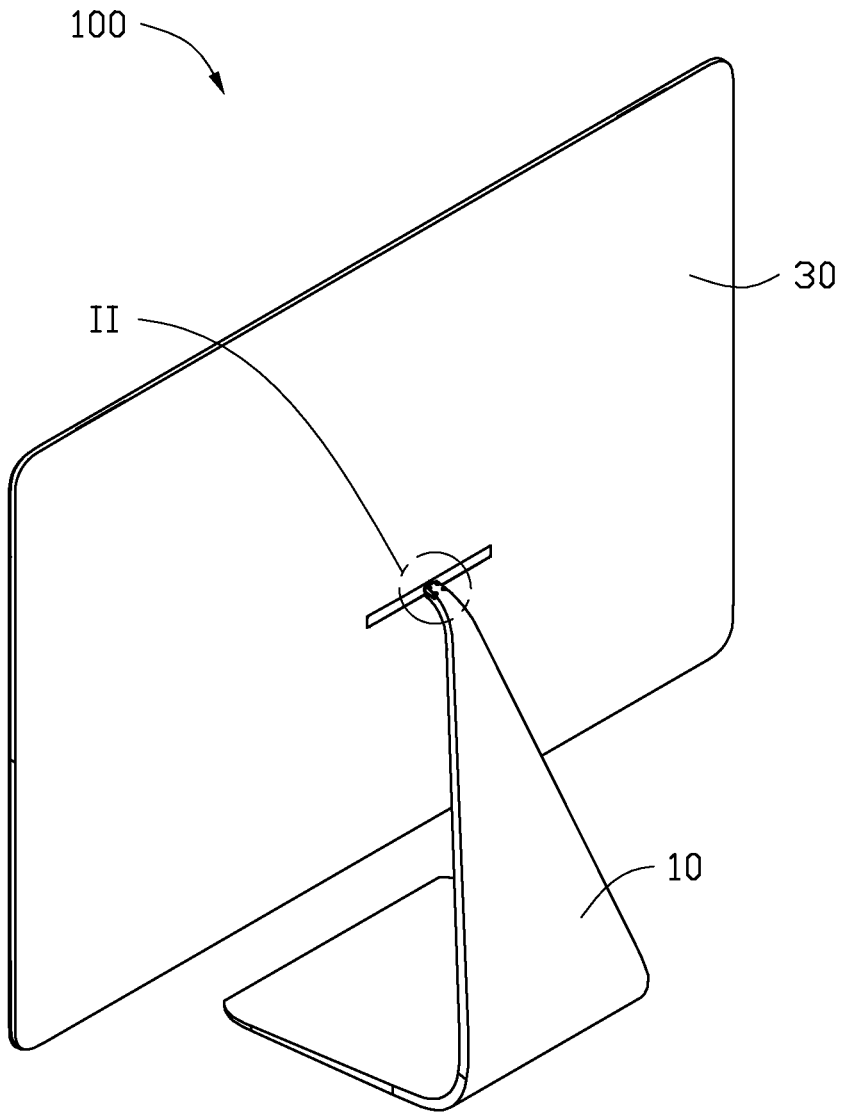
FIG. 1 is an isometric view of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

An electronic device can include a first member, a second member electrically and rotatably coupled to the first member, a cable connecting mechanism coupled to the first member and the second member, and a cable. The cable connecting mechanism can include a housing fixed in the second member and define a holding chamber, a pivot assembly rotatably and partially received in the holding chamber, and two elastic members. The pivot assembly can include a first conductive portion and a second conductive portion each with a first and a second curved surface matching with the holding chamber. The second conductive portion can be insulated from the first conductive portion. A first elastic member can extend through the housing to resist the first curved surface, and can be electrically coupled to the first conductive portion. A second elastic member can extend through the housing to resist the second curved surface, and can be electrically coupled to the second conductive portion. The cable can include a first wire extending through the first member and electrically coupled to the first conductive portion and a second wire extending through the first member and electrically coupled to the second conductive portion.

A cable connecting mechanism can include a housing fixed on the second member and defining a holding chamber, a pivot assembly rotatably and partially received in the holding chamber, and two elastic members. The pivot assembly can include a first conductive portion and a second conductive portion each with a first and a second curved surface matching with the holding chamber. The second conductive portion can be insulated from the first conductive portion. A first elastic member can extend through the housing to resist the first curved surface, and can be electrically coupled to the first conductive portion. A second elastic member can extend through the housing to resist the second curved surface, and can be electrically coupled to the second conductive portion.

Figure 3:
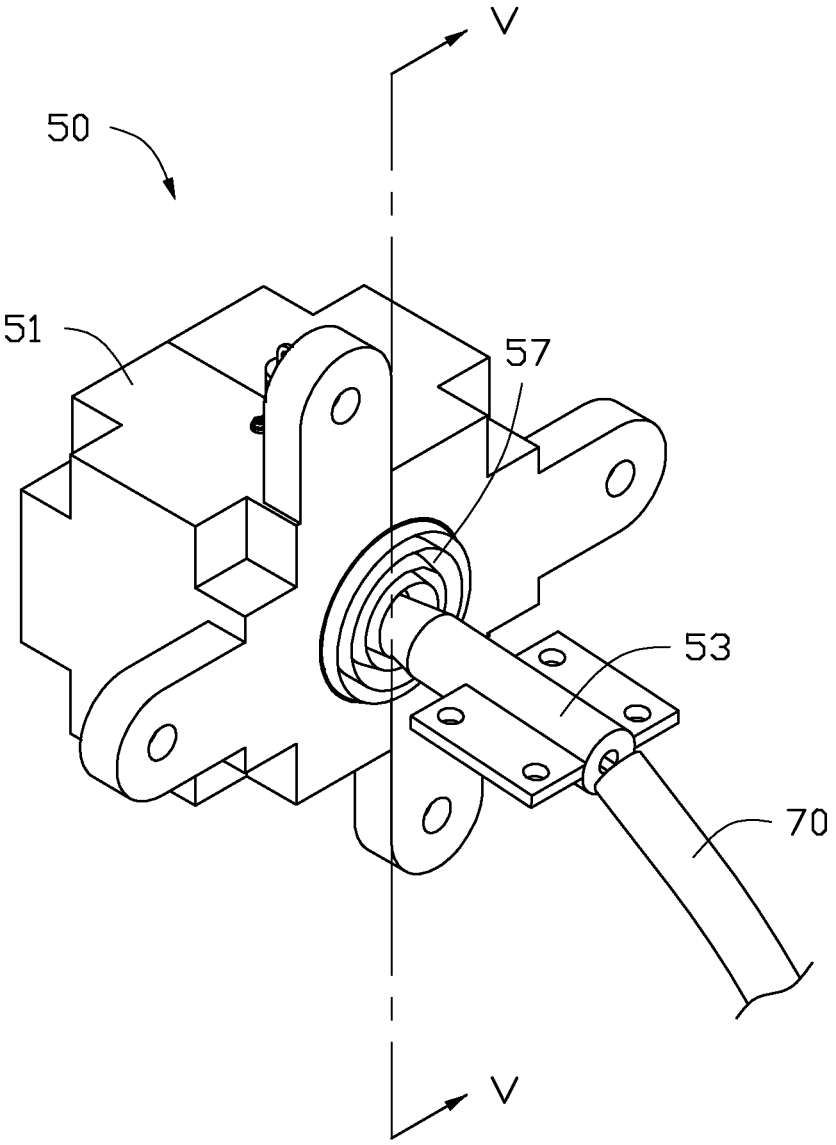
FIG. 3 is an isometric view of an embodiment of a cable connecting mechanism equipped with a cable.
Figure 4:
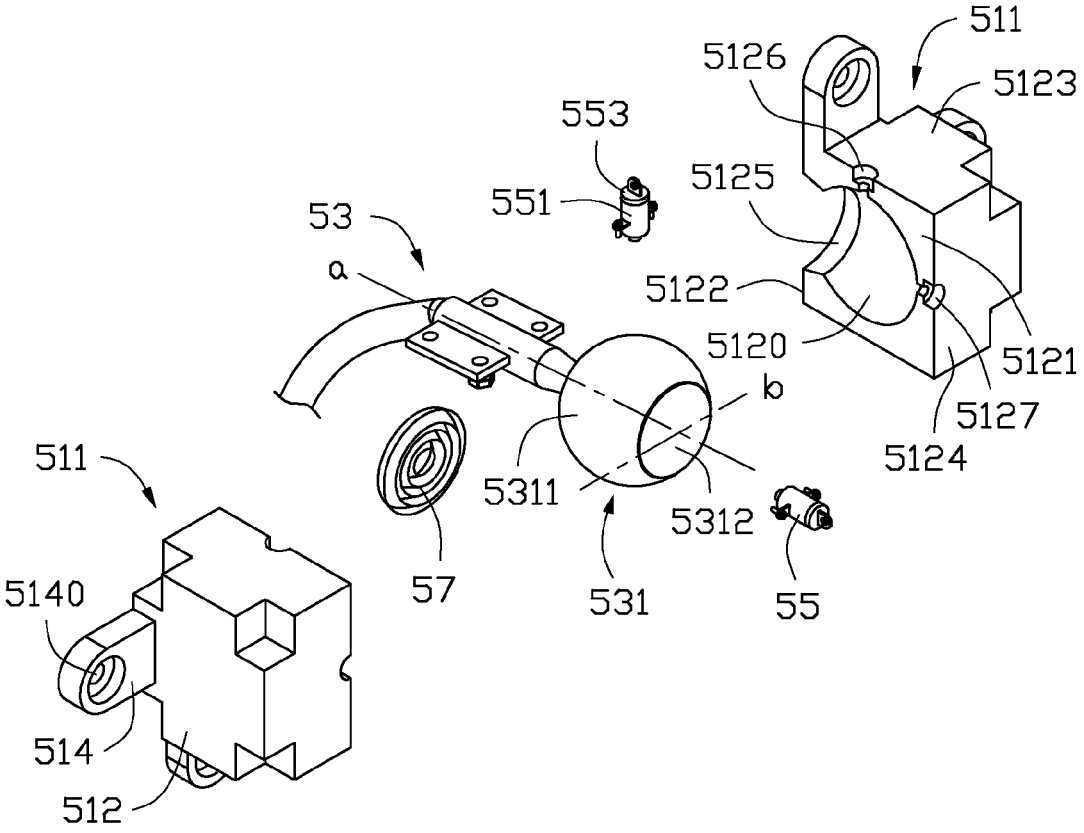
FIG. 4 is an exploded, isometric view of the cable connecting mechanism of FIG. 3.

FIGS. 1, 3 and 4 illustrate an embodiment of an electronic device 100. In at least one embodiment, the electronic device 100 can be an all-in-one computer. The electronic device 100 can include a support 10, a display 30, a cable connecting mechanism 50, and a cable 70. The display 30 can be rotatably coupled to the support 10 via the cable connecting mechanism 50. The display 30 can rotate 360 degrees around a first axis "o", and can rotate 60 degrees around a second axis "b" which is perpendicular to the first axis "o". The cable 70 can extend through the support 10, and can further extend into the cable connecting mechanism 90.

Figure 2:
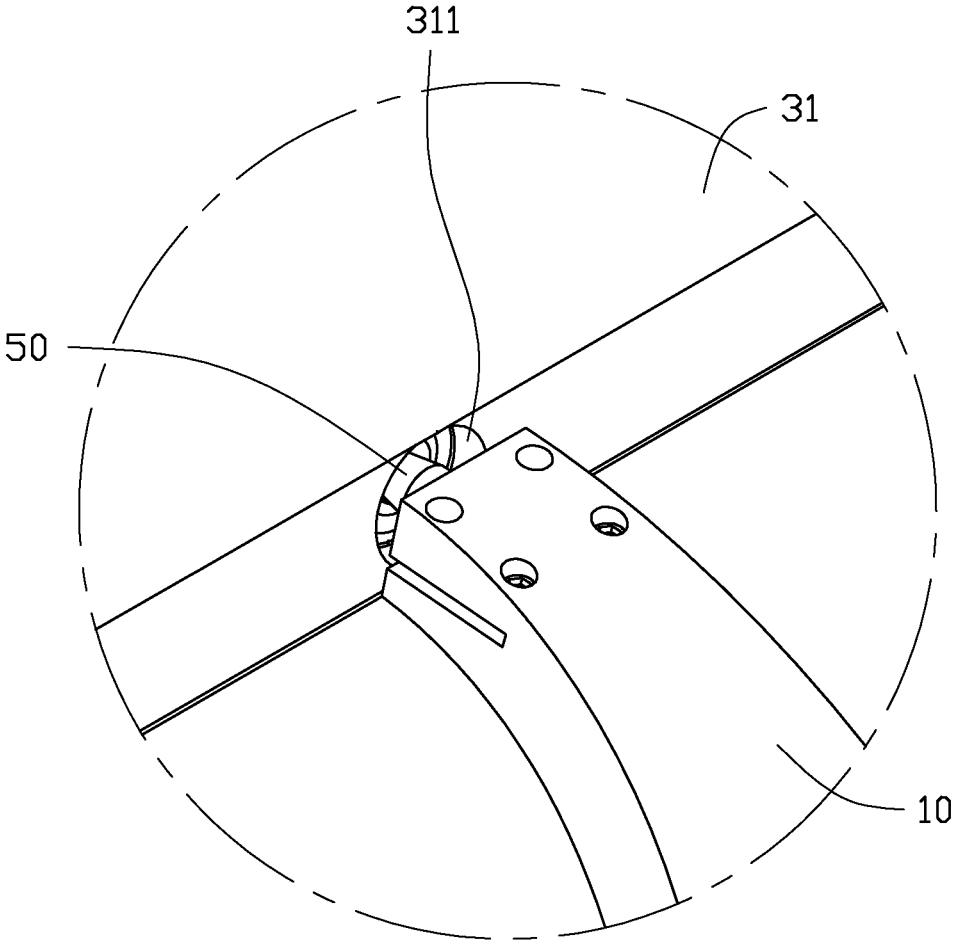
FIG. 2 is an enlarged view of circled portion II of the electronic device of FIG. 1.

FIGS. 1 to 3 illustrate that the support 10 can be substantially L-shaped, and can be configured to support the electronic device 100. The support 10 can define a cable hole (not shown) extending from opposite ends on a substantially central portion adjacent to the display 30, the cable hole can be configured to receive the cable 70. The display 30 can include a shell 31, and function modules (not shown) assembled in the shell 30. For simplicity, the description only describes the structure of the shell 31. The shell 31 can be substantially arc-shaped, and can define a mounting hole 311 in the substantially central portion adjacent to the support 10.

FIGS. 2 to 4 illustrate that the cable connecting mechanism 50 can be inserted into the mounting hole 311 to be partially positioned in the shell 31, and the cable 70 can be assembled to the cable connecting mechanism 50. The shell 31 can be rotatably coupled to the support 10 based on the cable connecting mechanism 50. The cable connecting mechanism 50 can include a housing 51, a pivot assembly 53, a pair of wire connecting assemblies 55, and a cover member 57. The pivot assembly 53 can be rotatably and partially received in the housing 51. The a pair of wire connecting assemblies 55 can be assembled on the housing 51, can be spaced from each other, and can resist the pivot assembly 53. The cover member 57 can cover the housing 51.

Figure 5:
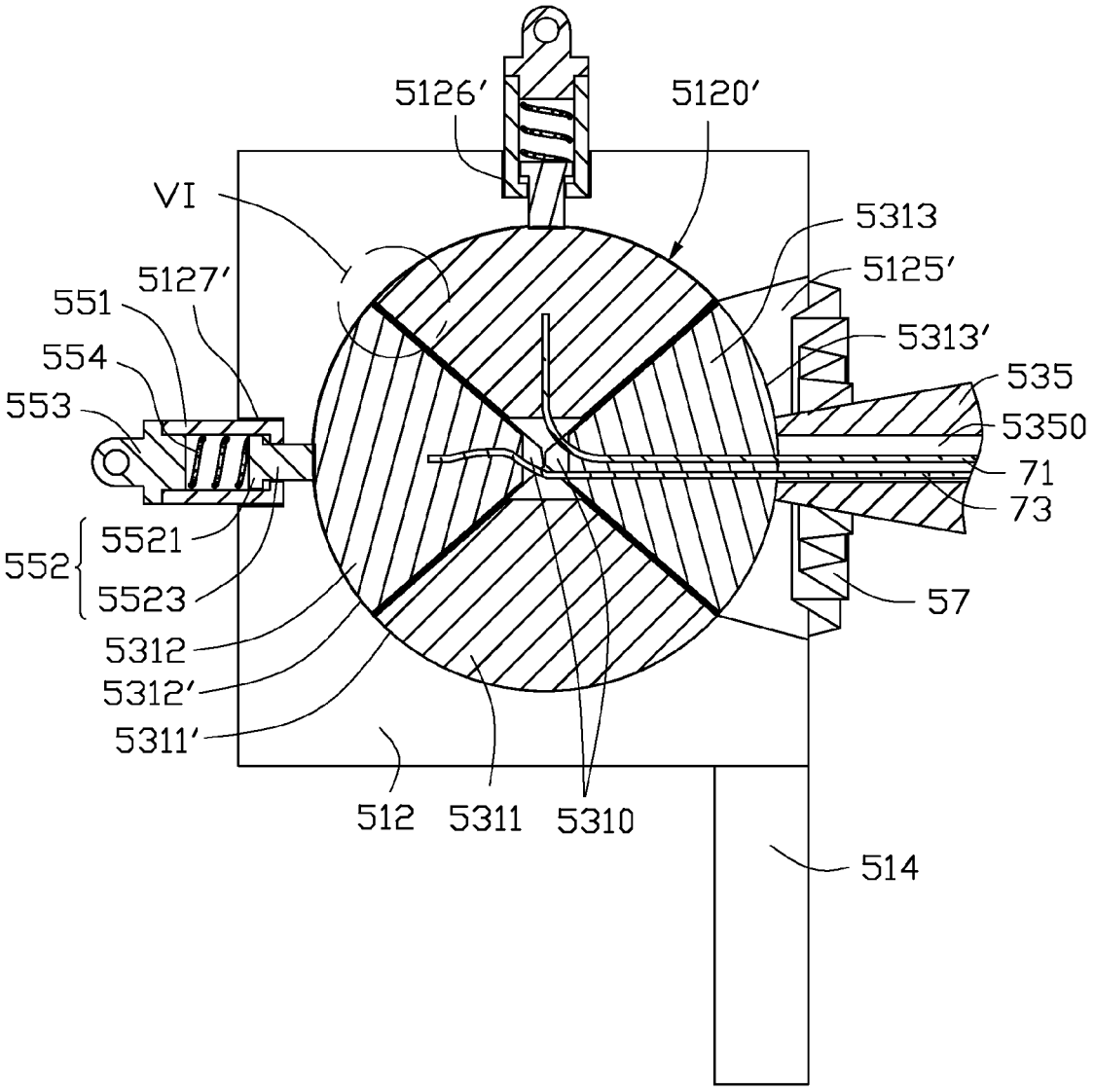
FIG. 5 is a cross-sectional view of the cable connecting mechanism, taken along line V-V of FIG. 3.

FIGS. 4 and 5 illustrate that the housing 51 can include a pair of mounting members 511 coupled to each other. Each mounting member 511 can include a base portion 512 and a connecting portion 514. The base portion 512 can be substantially a rectangular block, and can include a joint surface 5121, a first side 5122, a second side 5123, and a third side 5124. The first side 5122, the second side 5123, and the third side 5124 can respectively extend from peripheries of the joint surface 5121, and can be consecutively coupled to each other in order. The first side 5122 is opposite to the third side 5124. A receiving chamber 5120 can be defined on the joint surface 5124. The receiving chamber 5120 can be substantially hemispheric. A receiving hole 5125 can be defined on the first side 5123, and can communicate with the receiving chamber 5120. The receiving hole 5125 can be substantially semicircular. A first connecting slot 5126 can be defined on the second side 5123, and can communicate with the receiving chamber 5120. The first connecting slot 5126 can be substantially stepped. A second connecting slot 5127 can be defined on the third side 5124, and can communicate with the receiving chamber 5120. The second connecting slot 5127 can be substantially stepped.

The connecting portion 514 can extend from an end of the third side 5124, and can define a fixing hole 5140 extending through opposite sides. Each mounting member 511 can be fixed in the shell 31 via fasteners (not shown) through the corresponding fixing hole 5140. The pair of mounting members 511 can be arranged symmetrically. Two joint surfaces 5121 of the pair of mounting members 511 can be close together, thus two receiving chambers 5120 can cooperatively define a holding chamber 5120'. In at least one embodiment, the holding chamber 5120' can be a part of a spherical receiving chamber. In at least one embodiment, two first connecting slots 5126 can cooperatively define a first channel 5126'. The first channel 5126' can be circular. Two second connecting slots 5127 can cooperatively define a second channel 5127'. The second channel 5127' can be circular. Two receiving holes 5125 can cooperatively define a circular holding hole 5125'. An central axis of the first channel 5126' can be vertical to that of the second channel 5127', and the central axis of the second channel 5127' can coincide with that of the holding hole 5125'.

Figure 6:
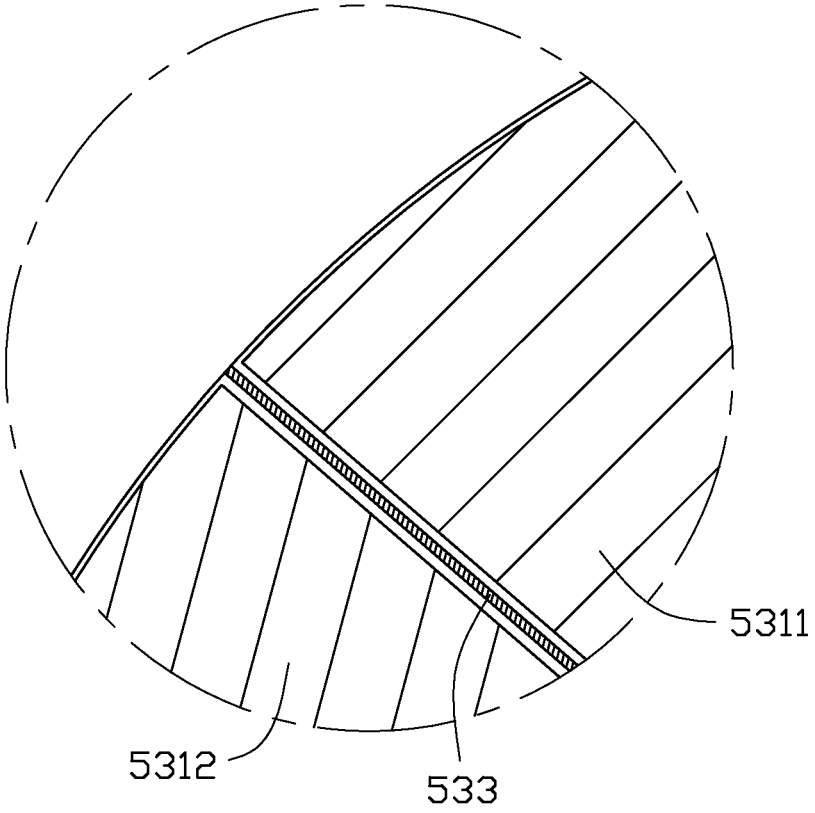
FIG. 6 is an enlarged view of circled portion VI of the cable connecting mechanism of FIG. 5.

FIGS. 4 to 6 illustrate that the pivot assembly 53 can be rotatably and partially received in the holding chamber 5120'. The pivot assembly 53 can include a conductive member 531, two insulated members 533, and a connecting member 535. The conductive member 531 can be substantially spherical structure, and can be rotatably positioned in the holding chamber 5120'. The conductive member 531 can include a first conductive portion 5311, a second conductive portion 5312, and a joint portion 5313. The first conductive portion 5311 can define two opposite holes 5310 on the outer surfaces, each hole 5310 can extend toward the central portion of the first conductive portion 5311. Shapes of the second conductive portion 5312 and the joint portion 5313 can match with the shape of the two holes 5310. The second conductive portion 5312 can be received in one hole 5310 adjacent to the support 10, and the joint portion 5313 can be received in another hole 5310. The first conductive portion 5311, the second conductive portion 5312, and the joint portion 5313 can cooperatively define a spherical member received in the holding chamber 5120'.

In at least one embodiment, each hole 5310 can be conical, and the central angle of each hole 5310 can be 60 degrees. The two holes 5310 can be arranged symmetrically. The first conductive portion 5311 can include a first curved surface 5311', a fan-shaped surface with the central angle of 120 degrees can rotate 360 degrees around the first axis "o" to form the first curved surface 5311'. The second conductive portion 5312 can include a second curved surface 5312', the fan-shaped surface with the central angle of 60 degrees can rotate 180 degrees around the first axis "o" to form the second curved surface 5312'. The joint portion 5313 can include a third curved surface 5313', a fan-shaped surface with the central angle of 60 degrees can rotate 180 degrees around the first axis "o" to form the third curved surface 5313'.

Two insulated members 533 can be received in two holes 5310, and can be located between the sidewalls of two holes 5310 and the second conductive portion 5312 or the joint portion 5313, respectively. In this way, the first conductive portion 5311 can be insulated from the second conductive portion 5312, and the first conductive portion 5311 can be insulated from the joint portion 5313. Each insulated member 533 can be substantially hollow and conical, and the shape of the insulated member 533 can match with that of the hole 5310. The connecting member 535 can be substantially rod-shaped. A first end of the connecting member 535 can be coupled to the joint portion 5313, and a second end of the connecting member 535 can extend through the holding hole 5125' to be coupled to the support 10. The connecting member 535 can define a wire hole 5350 to receive the cable 70.

The pair of wire connecting assemblies 55 can be securely mounted in the first channel 5126' and the second channel 5127', respectively. One wire connecting assembly 55 can be electrically coupled to, and push the first conductive portion 5311. Another wire connecting assembly 55 can be electrically coupled to, and push the second conductive portion 5312.

Each wire connecting assembly 55 can include a bushing 551, a resisting member 552, a cover 553, and an elastic member 554. The bushing 551 can be substantially hollow and can define a pair of opposite openings. The resisting member 552 can include an end portion 5521, and a resisting portion 5523 extending from the end portion 5521. The end portion 5521 can be received in the bushing 551. The resisting portion 5523 can be partially received in the bushing 551, and can extend through the bushing 551. The cover 553 can cover one end of the bushing 551, and can be configured to be coupled to the cable (not shown) received in the display 30. The elastic member 554 can be received in the bushing 551, and can resist between the cover 553 and the end portion 5521 of the resisting member 552. The resisting member 552, the elastic member 554, and the cover 553 can all be conductors.

The cover member 57 can be made of curly elastic materials, such as coiled springs. The cover member 57 can be sleeved on the connecting member 535, and can cover the holding hole 5125', so as to avoid contamination to the holding hole 5125'. In at least one embodiment, the cover member 57 can be omitted.

The cable 70 can include a first wire 71, and a second wire 73, respectively extending through the wire hole 5350 and the joint portion 5313 in order. The first wire 71 can extend into the first conductive portion 5311 to be electrically coupled to the first conductive portion 5311. The second wire 73 can extend into the second conductive portion 5312 to be electrically coupled to the second conductive portion 5312. In this way, the pair of wire connecting assemblies 55 can be electrically coupled to the first wire 71 and the second wire 73, respectively. In at least one embodiment, the first wire 71 can be neutral, the second wire 73 can be live.

The pivot assembly 53 and the cable 70 can be integrated via an insert molding method. In at least one embodiment, the pivot assembly 53 and the cable 70 can be formed separately, and then can be assembled together.

In assembly, first, the housing 51 of the cable connecting mechanism 50 can be assembled on the shell 31, and the connecting member 535 can extend through the mounting hole 311; and then the connecting member 535 can be coupled to an end of the support 10; and then the cable 70 can be inserted into the wire hole 11 of the support 10.

The first wire 71 and the second wire 5311 can be electrically coupled to the first conductive portion 5311 and the second conductive portion 5312 respectively, and the pair of wire connecting assemblies 55 can be electrically coupled to the first conductive portion 5311 and the second conductive portion 5312 respectively. When the display 30 rotates around the first axis "o", one wire connecting assembly 55 can move along the surface of the first conductive portion 5311, and can keep resistance and continuity with the first conductive portion 5311; another wire connecting assembly 55 can keep continuity with the second conductive portion 5312. When the display 30 rotates around the second axis "b", one wire connecting assembly 55 can move along the surface of the second conductive portion 5312, and can keep resistance and continuity with the second conductive portion 5312; another wire connecting assembly 55 can keep continuity with the first conductive portion 5311. In this way, when the display 30 rotates, the cable 70 does not rotate with the display 30 as such the wire does not wrap with the rotation. In at least one embodiment, the display 30 can rotate 360 degrees around the first axis "o", and can rotate 60 degrees around the second axis "b".

In at least one embodiment, the joint portion 5313 can be omitted, and the connecting member 535 can be connected to the first conductive portion 5311. In at least one embodiment, the connecting member 535 can be omitted, the joint portion 5313 can extend through the receiving hole 5125 to be coupled to the support 10. In at least one embodiment, the central angle of the hole 5310 can be changed according to the need, for example, when the display 30 needs to be rotated 90 degrees around the second axis "b", the central angle of the hole 5310 can be set as 90 degrees. In at least one embodiment, the shape of the first conductive portion 5311 can be changed as needed, for example, when the display 30 needs to be rotated 260 degrees around the first axis "o", the fan-shaped surface rotates 260 degrees around the first axis "o" and forms the first conductive portion 5311. In at least one embodiment, the bushings 551, the resisting members 552, and the covers 553 can be omitted, the elastic members 554 can be fixed on the housing 51. A first end of a first elastic member 554 can resist the first conductive portion 5311, and a second end of a first elastic member 554 can extend through the first channel 5126' and the second channel 5127' to be coupled to the cable 70. A first end of a second elastic member 554 can resist the second conductive portion 5312, and a second end of the second elastic member 554 can extend through the first channel 5126' and the second channel 5127' to be coupled to the cable 70.

In at least one embodiment, the cable connecting mechanism 50 cannot be limited to interconnect with the support 10 and the display 30 of the all-in-one computer, the cable connecting mechanism 50 can also be used to interconnect with a first member and a second member which is electrically coupled to the first member and rotates relative to the first member, for example, the cable connecting mechanism 50 can be used to interconnect with a car navigator and a car control panel.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. An electronic device comprising:
- a first member;
- a second member electrically and rotatably coupled to the first member;
- a cable connecting mechanism coupled to the first member and the second member comprising:
  - a housing fixed in the second member and defining a holding chamber,
  - a pivot assembly rotatably and partially received in the holding chamber and comprising:
    - a first conductive portion having a first curved surface matching with the holding chamber, and
    - a second conductive portion insulated from the first conductive portion and having a second curved surface matching with the holding chamber;
- a first elastic member extending through the housing to resist the first curved surface and being electrically coupled to the first conductive portion;
- a second elastic member extending through the housing to resist the second curved surface and being electrically coupled to the second conductive portion; and
- a cable comprising:
  - a first wire extending through the first member and electrically coupled to the first conductive portion, and
  - a second wire extending through the first member and electrically coupled to the second conductive portion.

2. The electronic device of claim 1, wherein the second member comprises a shell defining a mounting hole, the cable mechanism is inserted into the mounting hole to be partially positioned in the shell.

3. The electronic device of claim 1, wherein the first member is a support, and the second member is a display.

4. The electronic device of claim 1, wherein the housing comprises two mounting members coupled to each other, each mounting member defines a hemispheric receiving chamber on a side, two receiving chamber cooperatively define the holding chamber.

5. The electronic device of claim 4, wherein each mounting member further defines a first connecting slot and a second connecting slot communicating with the corresponding receiving chamber respectively on two adjacent sides, two first connecting slots cooperatively define a first channel to receive the first elastic member, and two second connecting slots cooperatively define a second channel to receive the second elastic member.

6. The electronic device of claim 5, wherein each mounting member further defines a receiving hole communicating with the corresponding receiving chamber on a side, two receiving hole cooperatively define a holding hole to receive the cable.

7. The electronic device of claim 1, wherein the cable connecting mechanism further comprises a first hollow bushing configured to receive the first elastic member, and a second hollow bushing configured to receive the second elastic member.

8. The electronic device of claim 7, wherein the cable connecting mechanism further comprises a first conductive resisting member and a second conductive member, the first resisting member is partially received in the first bushing to resist the first elastic member and extends through the housing to resist the first conductive portion, the second resisting member is partially received in the second bushing to resist the second elastic member and extends through the housing to resist the second conductive portion.

9. The electronic device of claim 8, wherein the cable connecting mechanism further comprises a first conductive cover configured to cover an end of the first bushing away from the first conductive portion, and a second conductive cover configured to cover an end of the second bushing away from the second conductive portion.

10. The electronic device of claim 1, wherein a fan-shaped surface with a central angle of degrees rotates degrees around a first axis to form the first curved surface, the fan-shaped surface with the central angle of degrees rotates degrees around the first axis to form the second curved surface.

11. The electronic device of claim 1, wherein the first conductive portion defines two opposite holes on outer surfaces, the second conductive portion is received in one holes, the pivot assembly further comprises a joint portion received in another hole and insulated from the first conductive portion.

12. The electronic device of claim 11, wherein the pivot assembly further comprises a connecting member defining a wire hole to receive the cable, a first end of the connecting member is fixed to the joint portion, and a second end of the connecting member extends through the housing to be coupled to the first member.

13. The electronic device of claim 12, wherein the cable connecting mechanism further comprises a cover member sleeved on the connecting member and covering the housing.

14. The electronic device of claim 11, wherein the pivot assembly further comprises two insulated members located between sidewalls of the two holes and the second conductive portion or the joint portion, respectively.

15. A cable connecting mechanism configured to rotatably join a first member and a second member together, and comprising:

a housing fixed on the second member and defining a holding chamber, a pivot assembly rotatably and partially received in the holding chamber and comprising:

a first conductive portion with a first curved surface matching with the holding chamber, and a second conductive portion insulated from the first conductive portion and having a second curved surface matching with the holding chamber;

a first elastic member extending through the housing to resist the first curved surface and being electrically coupled to the first conductive portion; and a second elastic member extending through the housing to resist the second curved surface and being electrically coupled to the second conductive portion.

16. The cable connecting mechanism of claim 15, wherein the cable connecting mechanism further comprises a first hollow bushing configured to receive the first elastic member, and a second hollow bushing configured to receive the second elastic member.

17. The cable connecting mechanism of claim 16, wherein the cable connecting mechanism further comprises a first conductive resisting member and a second conductive member, the first resisting member is partially received in the first bushing to resist the first elastic member and extends through the housing to resist the first conductive portion, the second resisting member is partially received in the second bushing to resist the second elastic member and extends through the housing to resist the second conductive portion.

18. The cable connecting mechanism of claim 17, wherein the cable connecting mechanism further comprises a first conductive cover configured to cover an end of the first bushing away from the first conductive portion, and a second conductive cover configured to cover an end of the second bushing away from the second conductive portion.

19. The cable connecting mechanism of claim 15, wherein the first conductive portion defines two opposite holes on outer surfaces, the second conductive portion is received in one holes, the pivot assembly further comprises a joint portion received in another hole and insulated from the first conductive portion.

20. The cable connecting mechanism of claim 19, wherein the pivot assembly further comprises a connecting member defining a wire hole to receive the cable, a first end of the connecting member is fixed to the joint portion, and a second end of the connecting member extends through the housing to be coupled to the first member.

* * * * *